United States Patent [19]

Levy

[11] 4,036,502

[45] July 19, 1977

[54] INDICATOR DEVICE

[76] Inventor: Barnett Levy, 8 Esterbrook Street, Westminster SW1P 4NL, London, England

[21] Appl. No.: 671,447

[22] Filed: Mar. 29, 1976

[30] Foreign Application Priority Data

Apr. 2, 1975 United Kingdom ..... 13540/75
Aug. 21, 1975 United Kingdom ..... 34841/75

[51] Int. Cl.[2] ..... A63F 5/04

[52] U.S. Cl. ..... 273/142 J; 116/120; 273/142 JD

[58] Field of Search ..... 116/129 F, 129 H, 129 N, 116/120, 133; 273/142 R, 142 C, 142 D, 142 H, 142 HA, 142 J, 142 JD, 141 R; 177/173; 308/DIG. 1; 46/47

[56] References Cited

U.S. PATENT DOCUMENTS

| | | | |
|---|---|---|---|
| 816,330 | 3/1906 | Johnston | 308/DIG. 1 |
| 2,075,442 | 3/1937 | Kickhofel | 273/142 R |
| 2,141,723 | 12/1938 | Pieper | 273/142 R X |
| 3,162,173 | 12/1964 | Morgan et al. | 116/129 F |
| 3,828,870 | 8/1974 | Schwarz | 177/155 |

FOREIGN PATENT DOCUMENTS

| | | | |
|---|---|---|---|
| 482,013 | 3/1938 | United Kingdom | 273/142 R |
| 413,981 | 7/1934 | United Kingdom | 273/142 J |

*Primary Examiner*—Richard C. Queisser
*Assistant Examiner*—Daniel M. Yasich
*Attorney, Agent, or Firm*—Emory L. Groff, Jr.

[57] ABSTRACT

An indicator device comprises a base member provided with a plurality of numbers, characters or other indicia arranged in a circle, a disc positioned on the base member for rotary movement relative thereto about the center of the circle, the disc having indicating effective at the same distance from the center of the circle as the numbers, characters or other indicia whereby a number, character or indicium can be indicated.

3 Claims, 6 Drawing Figures

INDICATOR DEVICE

BACKGROUND OF THE INVENTION

This invention relates to an indicator device.

SUMMARY OF THE INVENTION

It is an object of the invention to provide an indicator device for selecting numbers, characters or other indicia from a number of such indicia available. This selection may be of a type suitable for use in playing games, in conjunction, for example, with playing cards, board games, counters and the like and for selecting random indicia for such purposes as the choice of selections on football pools.

According to a first aspect of the invention, there is provided an indicator device comprising a base member, a plurality of numbers, characters or other indicia arranged in a circle on said base member, a disc positioned on said base member for rotary movement relative to said base member about the centre of said circle and defining an aperture at the same distance from said center of said circle as said plurality of numbers, characters or other indicia to enable one of said plurality of numbers, characters or indicia to be observed through said aperture and a knob or handle on said disc for rotating said disc relative to said base member.

According to a second aspect of the invention, there is provided an indicator device comprising a base member, a plurality of numbers, characters or other indicia arranged in a circle on said base member a disc positioned on said base member for rotary movement relative thereto about the centre of said circle, indicating means are effective at the same distance from said centre of said circle as said plurality of the numbers, characters or other indicia, means for locating said indicating means in register with any one of said plurality of numbers, characters or other indicia at which said indicating means may stop and means for moving the disc away from the base to free the locating means and enable spinning of the disc.

BRIEF DESCRIPTION OF THE DRAWINGS

The invention will now be described in greater detail, by way of example, with reference to the drawings, in which.

DESCRIPTION OF THE PREFERRED EMBODIMENTS

Figure 1:
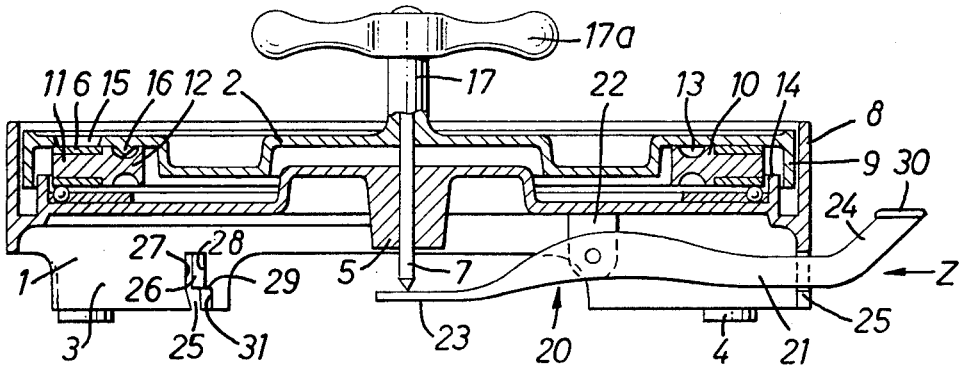
FIG. 1 is a sectional view through one embodiment of an indicator in accordance with the invention.
Figure 2:
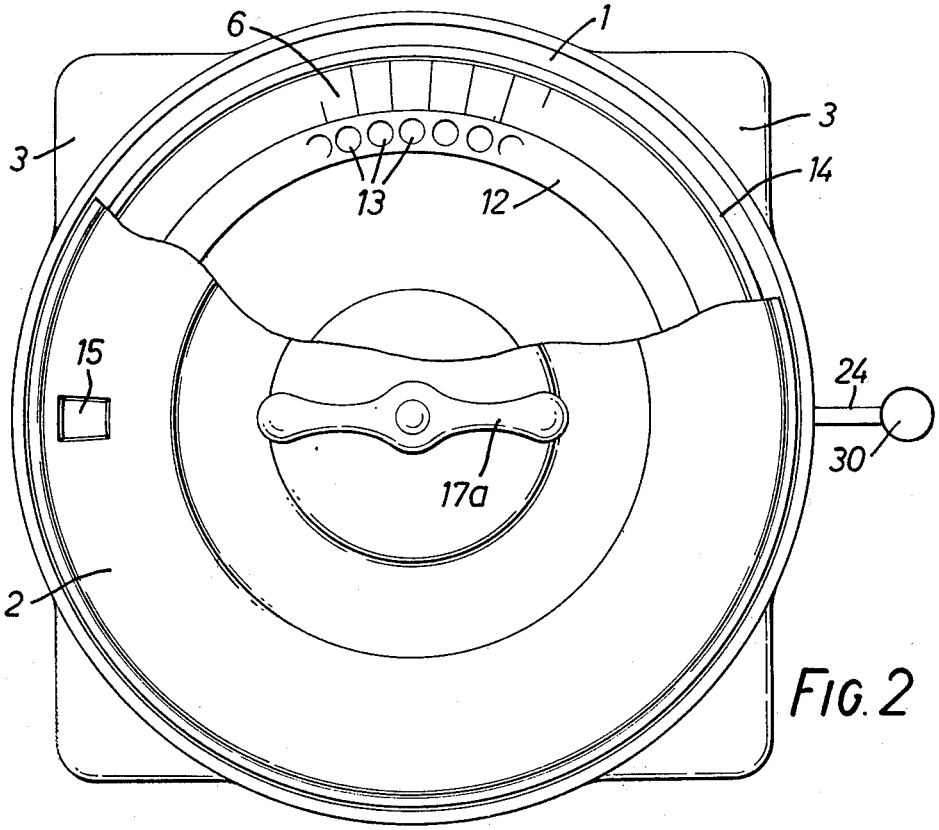
FIG. 2 is a plan view of the indicator with the disc partly broken away to show the arrangement of the numbers, characters or indicia arranged there-beneath.

Referring to FIGS. 1 and 2, the indicator shown comprises a base member 1 and a spinner disc 2. The base member 1 is provided with four downward extending portions 3, effectively forming legs which extend outwardly from the generally circular construction of the indicator, as can be particularly seen from FIG. 2. Annular feet 4 in the form of rubber or plastics members may be provided on the bottom of the legs 3. In the centre of the underside of the base member 1 there is provided a downwardly extending boss 5 which provides a bearing for the shaft 7 of the spinner disc 2. The base member 1 is provided at its outer edge with a circular upstanding rim 8 within which is located a downwardly extending rim 9 provided on the spinner disc 2. An indicia, number or character ring 10 is seated towards the outer edge of the base member 1 and may be single sided or double sided as shown. The ring 10 has an outer part 11 which is recessed to receive a thin ring 6 on which the numbers characters or indicia are provided and an inner part 12 which is provided for location purposes and includes a number of hemispherical depressions 13, one for each of the numbers, characters or indicia on the ring 6 on the outer part 11 of the ring 10. The indicia ring 10 is located on the base member 1 so as to be concentric with the axis of rotation of the spinner disc 2 by means of an upstanding circular rib 14 which engages the indicia ring 10 externally.

The spinner disc 2 is provided with a single window aperture 15 which is aligned radially with the indicia on the indicia ring 10 and is also provided with a conical projection 16, as shown adjacent the window 15, which will engage in the hemi-spherical depressions 13 provided in the indicia ring 10 so that when a spin has been completed it is ensured that the window 15 comes to lie over a particular one of the indicia and does not cover more than one indicium at a time. If desired a hemispherical projection may be used instead of the conical projection shown. On the upper central portion of the spinner disc 2 there is provided an upstanding spigot 17 which is used for the purpose of rotating the spinner disc 2. This may be suitably provided with one or more outwardly extending crossbars 17*a* so as to provide an easier grip for spinning purposes.

In order to spin the spinner disc 2, it is necessary to raise the spinner disc 2 above the indicia ring 10 so as to disengage the conical or hemi-spherical projection 16 from the hemi-spherical depressions 13. In order to maintain this spinner disc in a raised position during a spin, a lever mechanism, indicated at 20 is provided. The lever mechanism comprises a lever 21 which is amounted so as to be pivotable in a bearing arrangement 22 extending from the underside of the base member 1 and has one arm 23 which extends to a position under the shaft of the spinner disc 2, being so arranged that the shaft 7 of the spinner disc 2 rests thereon when the lever 21 is in a raised position. The outer end 24 of the lever extends outside the base member 1 and, in passing through the base member 1, co-operates with a specially shaped cam slot, which is indicated at 25. This slot has also been shown in a view taken in the direction of the arrow Z so that its shape can be more clearly determined, but in fact only one cam slot 25 is provided. In order for the lever 21 to be able to follow the shape of the cam slot 25 it is necessary for there to be a certain amount of play in the lever bearing arrangement 22. The outer end 24 of the lever 21 is suitably provided as an operating member and for this purpose may be provided with a finger plate 30. As can be seen, the cam slot 25 comprises a substantially vertially extending slot portion 26 having one side 27 curving in towards the opposite side 28 and this other side 28 is provided with a shoulder 29 and a rebated lower portion 31. As the outer end 24 of the lever 21 is pressed downwardly, the lever 21 moves downwardly along the left-hand side 27 of the slot 26 and is thereby moved over until it takes up a position below the shoulder 29, provided on the other side 28 of the slot 26. On release of the lever 21 it will move upwards only as far as the shoulder 29, whereby further upward movement is prevented until the lever 21 is moved sideways to disengage it from the shoulder 29. In this way, pressure on the lever 21 will raise the spinner disc 2 and it will remain in the raised position until released. Suitably the lever 21 may be biassed so that the left-hand 23 of the lever will, in the absence of the weight of the spinner disc 2, rise and the right hand end 24 of the lever will drop. In these circumstances, the spinner disc 2 can be operated by lifting the spinner disc whereupon the lever 21 will automatically follow and will take up its locked position holding the spinner disc 2 in the raised position. The spinner disc 2 can then be spun and, at a suitable point during the spin, the lever 21 can be released, dropping the spinner disc 2 on the base member 1 whereupon the conical or hemi-spherical projection 16 will engage in one of the hemi-spherical depressions 13 in the indicia ring 10. The engagement of the projection 16 in the depression 13 will not, if the ring 10 is stationary take place immediately, but the projection 16 will bounce from depression to depression until the rotation of the disc 2 has been sufficiently reduced to enable a depression 13 to "catch" the hemi-spherical depression 16 and bring the disc 2 to a halt. Alternatively, if the ring 10 is loosely mounted, it can rotate with the spinner disc 2 once the spinner disc 2 has been lowered to such an extent that the hemi-spherical projection 16 falls into a hemi-spherical depression 13. To assist rotation of the ring, stationary or movable ball bearing 31 maybe provided on the base to reduce friction.

The arrangement of the edges of both the base member 1 and the disc 2 is such that air will be trapped between the spinner disc and the base member, thus reducing the speed at which the spinner disc will drop and thus increasing the spinning distance after release of the lever. If the window aperture 15 which is provided in the disc remains open, air will readily escape therethrough, but should the aperture be filled with a transparent material, and with reasonable accuracy of the construction of the base member and the spinner disc the air will remain trapped between the spinner disc and the base member for a considerable time.

Alternatively, if it is desired to slow down the drop of the spinner disc on to the base member, some form of dash pot arrangement of other retarding mechanism can be used.

Figure 3:
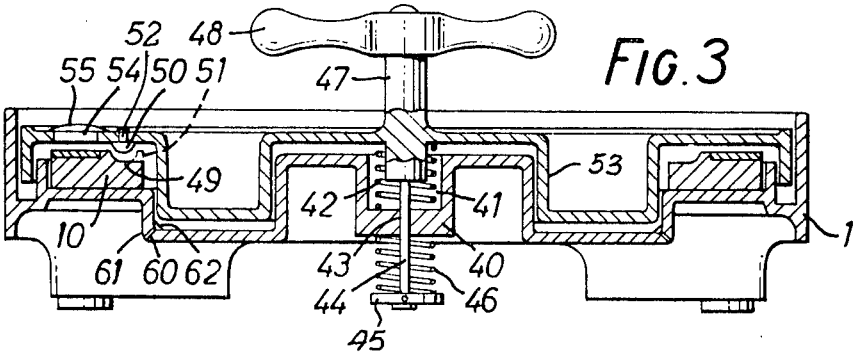
FIG. 3 is a sectional view of a further embodiment.

FIG. 3 shows a section through a second embodiment of the invention. This again comprises a base member 1 and a spinner disc 53. As can be seen, the spinner disc has substantially the same profile as the surface of the base member 1, including the upper surface of the indicia ring 10.

In the center of the underside of the base member 1, a downwardly extending boss 40 is provided and this boss 40 has a hollow chamber 41 accommodating a spring 42. The bottom of the chamber 41 is apertured at 43 to receive the shaft 44 of the spinner disc 53. In this way a bearing or guide surface for the shaft 44 of the spinner disc 53 is provided by the aperture 43 and the bottom of the chamber 41 provides a bearing surface for the spring 42. The spring 42 also supports part of the weight of the spinner disc 53 in applications of the device in which the device is used horizontally. The shaft 44 extends beyond the boss 40 and ends in a removable stop 45. A second spring 46 is shown provided on the extension of the shaft 44. This spring may in fact be the spring 42 as will be hereinafter described.

The centre of the spinner disc has effectively an upward shaft extension 47 at the upper end of which is provided a handle 48 by means of which the spinner disc can be raised to enable it to be spun.

The combined shapes of the spinner disc and base surface allow for the formation of an air cushion between the two when the spinner disc is rotating so as to prevent its untimely return into its lower position.

As in the previous embodiment (FIGS. 1 and 2) the device is provided with an indicia ring 10, here shown single sided. This ring has depressions 49 which co-operate with a projection 50 on the spinner disc to locate the spinner disc as it comes to rest. As shown, the depressions may be open ended radial grooves or may be hemi-spherical depressions (dotted line 51) as in the previous embodiment. The projection 50 may be of any suitable co-operating shape and can be made replaceable as shown. In this case the hemi-spherical projection has a stem 52 passing through an aperture in the spinner disc 53 and retained in position by a split ring, split pin or the like 54. The projection 50 may thus be made of plastics, rubber or other suitable material.

The spinner disc has, as in the previous embodiments an aperture 54, through which the indicia ring may be viewed and, as shown, in the present instance is provided with a lens inset or cover 55.

The device has been designed for use either horizontally or vertically, only one of the springs 41 and 46 being necessary. The spring 41 is used in the horizontal position to take some of the weight of the spinner disc and the spring 46 is used in the vertical position to pull in the spinner disc for engagement of the projection 50 in one of the depressions 49. (This action taking place under gravity in the horizontal position). For a device convertable for use in both positions, the spring may be moved from its 41 position to its 46 position and vice versa.

In operation, the spinner disc 53 is raised and spun by means of the handle 48 and the disc will then spin and gradually seat back in the base, this seating being delayed by the air cushion formed. Should initial raising of the disc produce too great a suction to allow raising to be carried out easily, one way valves may be incorporated in the base, such as the flap valves indicated at 60 consisting of vent holes 61 and a rubber flap 62.

As the disc returns to its original position either under the action of gravity (horizontal) or the spring 46 (vertical) the projection 50 will engage the depression 49 and bring the disc to a halt. The halt position will be accurately adjusted to the indicia by co-operation of the projection 50 and one of the depressions. The indicia at the stopping point can then be read off through the window 54.

Figure 4:
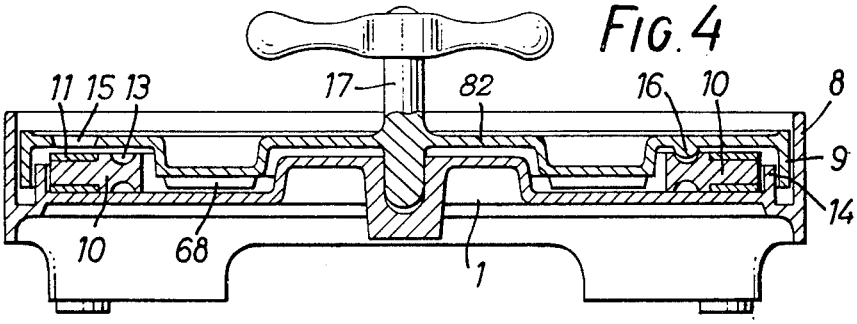
FIG. 4 is a sectional view similar to FIG. 1, but showing a further embodiment.

Referring now to FIG. 4, an alternative form of arrangement is provided. In this embodiment, the general shape of the spinner disc 82 is similar to that in the embodiment shown in FIG. 1, but in this case it is provided with vanes 68 provided on the spinner disc to enhance the air cushion.

Figure 5:
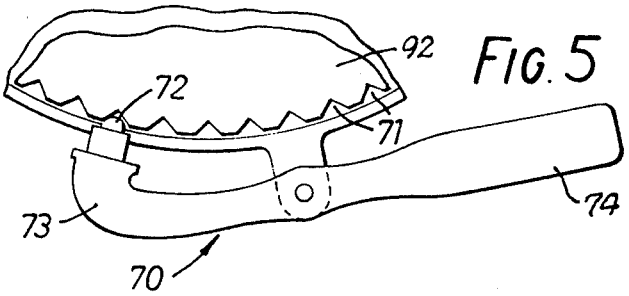
FIG. 5 is a partial plan view showing an arresting mechanism.

FIG. 5 shows an alternative arrangement for arranging for arresting the spinner disc 92. In this case, the peripheral surface of the spinner disc 92 is provided with a number of V-shaped notches 71, each of which corresponds to one of the indicia which is provided in a ring underneath in the usual way. However, although each V-shaped notch corresponds to a particular number or other indication, it will not of course be physically associated therewith. The arresting device 70 which cooperates with these V-shaped notches 71, comprises a ball 72 which is provided in a lever arm 73 which may suitably be spring urged by means of a spring (not shown) into engagement with the spinner disc 92. In order to operate the arrangement, the handle 74 which is provided on the lever can be pushed inwards to remove the ball 72 from its appropriate notch 71 and the spinner disc 92 can then be spun. After the spinner disc 92 has been spun, the handle 74 may be released and the ball 72 allowed to engage the periphery of the spinner disc 92. After a time, the ball will have slowed down the spinner to such an extent that it stops and the ball 72 will engage in a particular V-shaped notch 71 whereupon a number or other indicia can be read through a window in the spinner.

The arrester which is shown in FIG. 5 may also be used as a means for arresting the spinner and retaining it in its arrested position or it may be held away from the spinner and only allowed to engage the appropriate notch once the spinner disc 92 has come to rest.

Figure 6:
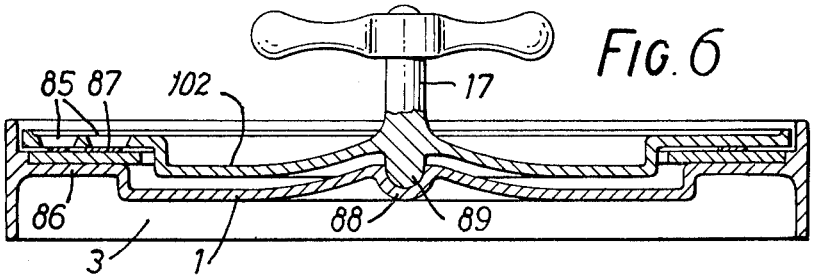
FIG. 6 is a view similar to FIG. 1 showing a simplified form of indicator device.

FIG. 6 shows a simplified form of indicator device. This indicator device comprises the base portion 1 of a circular nature and the spinner disc 102 to be positioned thereon. For this purpose the base 1 has a raised ledge portion 86 adapted to receive a flat indicia carrier 87 and in the centre a socket portion 88 for receipt of the pivotal part 89 of the spinner disc 102. The spinner disc 2 is as, previously provided in the centre with a knob 17 by which it can be turned, the knob having effectively a portion 89 projecting downwards therefrom for engagement in the socket portion 88 provided in the base portion 1. The spinner disc 102 has a plurality of apertures 85, for example, three aperture arrangements spaced by 120° each, and each aperture arrangement comprises, for example, two windows 85 in staggered relationship with each other, one on an outside track and one on an inside track.

It is to be understood, however, that while the indicia carrier 87 will have two rings of indicia, for example, numbers to cooperate with the pairs of apertures 85, a single ring may be used and the spinner disc 102 may only have a single aperture 85, or a single pair of apertures. While the spinner disc 102 with the three aperture arrangements will of course be balanced, since the apertures 85 in the spinner disc 102 are all set 120° apart, where only a single aperture or a pair of apertures is provided, it is necessary to provide a counter balance so as to ensure proper balance of the spinner disc. This counter balance may suitably take the form of either a suitable counter adjustment opposite to the apertures and this will normally take the form of a blind window. On the other hand, the mass of the material which has been removed from the windows 85 can be reinstated by the provision of a build-up of the spinner to provide the windows with a frame-like arrangement (not shown). It will be seen that in the embodiment shown, the windows 85 are narrowed as they extend through the spinner disc 102 so as to provide easier and more accurate reading of the indicia beneath them. As can be seen, the indicia carrying member 87 sits on the ledge portion 86 provided by the base part 1 of the indicator device, and, by lifting the spinner disc 102 from the base part 1, the indicia carrier 87 may be removed. The indicia of the removed indicia carrier may be replaced by a new set of indicia which may be provided as a separate ring or may be printed on the reverse side of the removed indicia carrier as in the other embodiments.

It will be appreciated that various modifications can be made to the above described embodiments without departing from the scope of the invention. For example, any of the features of the described embodiments may be applied to the other embodiments where these are suitable.

What is claimed is:

1. An indicator device comprising a base member, a ring positioned on said base member, a plurality of characters arranged around said ring, a spindle passing through said base member at the center of said ring, a disc carried by said spindle for rotary movement relative to said ring about the center of said ring, a handle on said disc for rotating said disc relative to said base member, indicating means on said disc for indicating one of said plurality of characters, cooperating locating means on both said disc and said ring, said locating means engageable with each other for locating said indicating means in register with any one of said plurality of characters at which said indicating means may stop, said ring locating means entraining said ring when both said locating means are engaged and a lever mechanism acting on said spindle for moving said disc away from said base member to disengage said cooperating locating means and enable spinning of the disc.

2. An indicator device as defined in claim 1, wherein said locating means comprises a plurality of hemispherical depressions in said ring, one for each of said plurality of characters and a projection on said disc cooperating with said hemi-spherical depressions.

3. An indicator device as defined in claim 1, and comprising cooperating portions on said base member and on said disc are configured for producing an air cushion between said disc and said base member when said disc is rotating to increase the number of rotations of said disc made during a spin thereof.

* * * * *